US006876288B2

(12) United States Patent
Gavrilin et al.

(10) Patent No.: US 6,876,288 B2
(45) Date of Patent: Apr. 5, 2005

(54) TRANSVERSE FIELD BITTER-TYPE MAGNET

(76) Inventors: Andrey V. Gavrilin, 501 Blairstone Rd., #1224, Tallahassee, FL (US) 32301; Mark D. Bird, 8750 Cabin Hill Rd., Tallahassee, FL (US) 32311

( * ) Notice: Subject to any disclaimer, the term of this patent is extended or adjusted under 35 U.S.C. 154(b) by 148 days.

(21) Appl. No.: 10/395,738

(22) Filed: Mar. 24, 2003

(65) Prior Publication Data

US 2003/0184427 A1 Oct. 2, 2003

Related U.S. Application Data

(60) Provisional application No. 60/368,349, filed on Mar. 29, 2002.

(51) Int. Cl.[7] ..... H01F 5/00

(52) U.S. Cl. ..... 336/200; 335/299; 335/300; 324/320; 324/318

(58) Field of Search ..... 336/200, 199, 336/232; 324/318, 319, 320, 321; 335/299, 300; 403/272, 271, 339; 439/824

(56) References Cited

U.S. PATENT DOCUMENTS

| | | | |
|---|---|---|---|
| 4,736,176 | A | 4/1988 | Aubert |
| 4,743,879 | A | 5/1988 | Aubert |
| 4,748,429 | A | 5/1988 | Aubert |
| 4,774,487 | A | 9/1988 | Aubert |
| 4,808,956 | A | 2/1989 | Aubert |
| 4,823,101 | A | 4/1989 | Aubert |

*Primary Examiner*—Lincoln Donovan
*Assistant Examiner*—Jennifer A. Poker
(74) *Attorney, Agent, or Firm*—John Wiley Horton

(57) ABSTRACT

A new type of coil magnet in which the plane of each turn of the conducting coil is rotated with respect to the central axis. This results in the induced magnetic field being oriented off the central axis. A set of two such disk assemblies are preferably nested, with the current flowing in opposite directions within the two assemblies. This results in the components of the two induced magnetic fields lying along the center axis canceling each other out, leaving only a purely transverse magnetic field. In addition, variations in the angular offset of the nested coils can be used to create a magnetic field having almost any orientation. Three or more such nested disk assemblies can be employed to strengthen and adjust the transverse magnetic field.

13 Claims, 24 Drawing Sheets

TRANSVERSE FIELD BITTER-TYPE MAGNET

CROSS-REFERENCES TO RELATED APPLICATIONS

This is a non-provisional application which claims the benefit of an earlier-filed provisional application pursuant to 37 C.F.R. §1.53(c). The earlier application was filed on Mar. 29, 2002, and was assigned Ser. No. 60/368,349.

STATEMENT REGARDING FEDERALLY SPONSORED RESEARCH OR DEVELOPMENT

This invention was developed at the National High Magnetic Field Laboratory in Tallahassee, Fla. The research and development has been federally sponsored.

MICROFICHE APPENDIX

Not Applicable

BACKGROUND OF THE INVENTION

1. Field of the Invention.

This invention relates to the field of electromagnets. More specifically, the invention comprises a tilted Bitter-disk type magnet capable of producing a uniform field which is transverse to the center axis of the coil.

2. Description of the Related Art.

Bitter-disk type electromagnets have been in use for many decades. While it is true that those skilled in the art are familiar with their design and construction, a brief explanation of the prior art will be helpful in understanding the proposed invention.

FIG. 1 shows a prior art Bitter-disk magnet. End plate 12 is the anchoring point for a number of radially-spaced tie rods 16. In practice tie rods 16 have uniform length. Some of these are shown cut away in order to aid visualization of other components. A Bitter-disk magnet is typically constructed by stacking the components. Starting with end plate 12, tie rods 16 are added. A series of conducting disks 18 are then slipped onto tie rods 16. The reader will observe that each conducting disk 18 has a series of holes designed to accommodate tie rods 16. Conducting disks 18 are made of thin conductive material, such as copper or aluminum.

Turning briefly to FIG. 2, the reader may observe conducting disk 18 in more detail. Tie rod holes 24 are uniformly spaced around its perimeter. Cooling holes 26 are also spaced about conducting disk 18. These holes are sometimes made as elongated slots in more complex patterns to optimize both cooling and mechanical strength. As they are not important features of the present invention, however, they have been illustrated simply. In order to avoid visual clutter, the cooling holes have not been illustrated at all in FIG. 1.

FIG. 2 shows cut 22 in conducting disk 18. This is a radial cut extending completely through one side of the disk. The reader will observe that the two sides of the disk have been displaced vertically, with the result that conducting disk 18 forms one turn of a helix having a shallow pitch. Upper side 62 of cut 22 is higher than lower side 60. The importance of this fact will become apparent as the construction of the device is explained further.

Prior art Bitter magnets are made in several different ways. The specifics of the prior art construction techniques are not critical to the present invention, since the present invention could be constructed using any of the prior art techniques. However, in order to aid the understanding of those not skilled in the art, one of the prior art construction techniques will be discussed in detail:

Returning now to FIG. 1, the reader will observe that six conducting disks 18 are initially placed over tie rods 16 (the lowest part of the stack in the view). As they are stacked, each successive disk is indexed 1/15 turn in the clockwise direction (corresponding to the fact that there are 15 tie rods 16). Turning to FIG. 3, the effect of the rotational indexing may be more readily observed. Six conducting disks 18 have been assembled to create conductor stack 30. Conducting disks 18 have also been "nested" together. The 1/15 turn is an arbitrary figure—corresponding to the use of 15 tie rods. If 16 tie rods were used, the appropriate index could be 1/16 turn. Rotational indexing as large as 1/3 turn is in common use, especially for smaller diameter stacks.

The disks are nested in the manner shown, so that upper side 62 of one conductor disk 18 lies over upper side 62 of the conductor disk 18 just below it. The disks in FIG. 3 are shown with a significant gap between them. The Bitter-disk assembly method squeezes the disks tightly together when the device is complete. When squeezed together, conducting disks 18 form one integral conductor having a helical shape—albeit with a very shallow pitch. Conductor stack 30 then forms a portion of one turn of the Bitter-disk magnet.

Returning now to FIG. 1, the description of the prior art device will be continued. The reader will observe that four conductor stacks 30 are shown in the assembly (in the uncompressed state). In reality, many such conductor stacks 30 will be stacked onto tie rods 16.

The desired result is to accommodate a large electrical current flowing through a helix having a shallow pitch. The desired path of current flow commences with input conductor 64 on end plate 12 (which makes contact with the underside of the lowermost conducting disk 18). A second end plate 12 (not shown) will form the upper boundary of the assembly ("sandwiching" the other components in between). The current will then exit the device through a corresponding output conductor on the upper end plate 12. Those skilled in the art will realize that if one simply stacks a number of conductor stacks 30 on the device, the electrical current will not flow in the desired helix. Rather, it will simply flow directly from the lower end plate 12 to the upper end plate 12 in a linear fashion. An additional element is required to prevent this.

Insulating disks 20 are placed within each conductor stack 30 to prevent the aforementioned linear current flow. Each insulating disk 20 is made of a material having a very high electrical resistance. The dimensional features of each insulating disk 20 (tie rod holes, cooling holes, etc.) are similar to the dimensional features of conducting disks 18. Each conductor stack 30 incorporates one insulating disk 20 nested into the stack. FIG. 1B shows a detail of this arrangement. The reader will observe the upper portion and lower portion of each insulating disk 20 (both are labeled as "20" in the view so that the reader may easily distinguish them from conducting disks 18). The reader will also observe how each insulating disk 20 nests into the helix formed by the six conducting disks 18.

FIG. 3 also illustrates this arrangement. Insulating disk 20 is placed immediately over the first conducting disk 18. It then follows the same helical pattern as the conducting disk 18. Returning now to FIG. 1, the cumulative effect of this construction will be explained. The four conductor stacks 30 shown in FIG. 1 are identical. When they are compressed together, the four insulating disks 20 will form one continuous helix through the stacked conducting disks 18. Thus, the construction disclosed forces a helical flow of electrical current through the device.

Those skilled in the art will realize that when a substantial electrical current is passed through Bitter magnet 10, strong mechanical forces are created (Lorentz forces). Significant heat is also introduced through resistive losses. Thus, the device must be able to withstand large internal mechanical forces, and it must also be able to dissipate heat. Once the entire device is assembled with the two end plates 12 in place, the end plates are mechanically forced toward each other. The lower ends of tie rods 16 are anchored in the lower end plate 12. The upper ends pass through holes in the upper end plate 12. The exposed upper ends are threaded so that a set of nuts can be threaded onto the exposed ends of tie rods 16 and tightened to draw the entire assembly tightly together. In this fashion, the device is capable of resisting the Lorentz forces, which generally tend to move the disks and other components relative to each other.

Because Bitter magnet 10 generates substantial heat during operation, natural convective cooling is generally inadequate. Forced convective cooling, using deionized water, oil, or liquid nitrogen is therefore employed. A sealed cooling jacket is created by providing an inner cylindrical wall bounded on its lower end by central hole 14 in the lower end plate 12, and bounded on its lower end by central hole 14 in the upper end plate 12. An outer cylindrical wall is provided outside the outer perimeter of the disks, extending from the lower end plate 12 to the upper end plate 12. All the components illustrated are thereby encased in a sealed chamber. The liquid is then forced into the cooling jacket, where it flows from one end of the device to the other through the aligned cooling holes 26 in the stacked disks (the cooling holes align in the conducting and insulating disks). In FIG. 1, the cooling flow would be linear from top to bottom or bottom to top.

Those skilled in the art will realize that the completed Bitter magnet 10 will generate an intense magnetic field within the cylindrical cavity within the inner cylindrical wall. Those skilled in the art will also realize that it is possible to generate an even greater magnetic field by nesting concentric Bitter-type coils. All these components are well known within the prior art.

The principle limitation of the prior art Bitter-type magnets is that they can only produce a longitudinal magnetic field—aligned with the central axis of the coil. The present invention seeks to overcome this limitation through the use of a modified Bitter magnet.

BRIEF SUMMARY OF THE INVENTION

The present invention comprises a new type of electromagnet in which the plane of each turn of the conducting coil is rotated with respect to the central axis. This results in the induced magnetic field being oriented off the central axis. A set of two such coil assemblies are preferably nested, with the current flowing in opposite directions within the two coils. This results in the components of the two induced magnetic fields lying along the center axis canceling each other out, leaving only a purely transverse magnetic field. In addition, variations in the angular offset of the nested coils can be used to create a magnetic field having almost any orientation. Three or more such nested conductor assemblies can be employed to strengthen and adjust the transverse magnetic field.

REFERENCE NUMERALS IN THE DRAWINGS

| | | | |
|---|---|---|---|
| 10 | Bitter magnet | 12 | end plate |
| 14 | central hole | 16 | tie rod |
| 18 | conducting disk | 20 | insulating disk |
| 22 | cut | 24 | tie rod hole |
| 26 | cooling hole | 28 | sector cut |
| 30 | conductor stack | 32 | angled end plate |
| 34 | 45° conducting disk | 36 | 45° conductor stack |
| 38 | projected center bore | 40 | projected tie rod hole |
| 42 | first Bitter coil | 44 | second Bitter coil |
| 46 | first coil current | 48 | second coil current |
| 50 | first induced field | 52 | second induced field |
| 54 | resultant field | 56 | third Bitter coil |
| 58 | fourth Bitter coil | 60 | lower side |
| 62 | upper side | 64 | input conductor |
| 66 | simplified helix | 68 | center axis |
| 70 | third coil current | 72 | fourth coil current |

-continued

| | | | |
|---|---|---|---|
| 74 | transverse field Bitter magnet | | |
| 78 | square disk stack | 80 | elliptical bore |
| 82 | theoretical turn plane | 84 | perpendicular plane |
| 86 | turn plane normal vector | | |

DETAILED DESCRIPTION OF THE INVENTION

Figure 1:
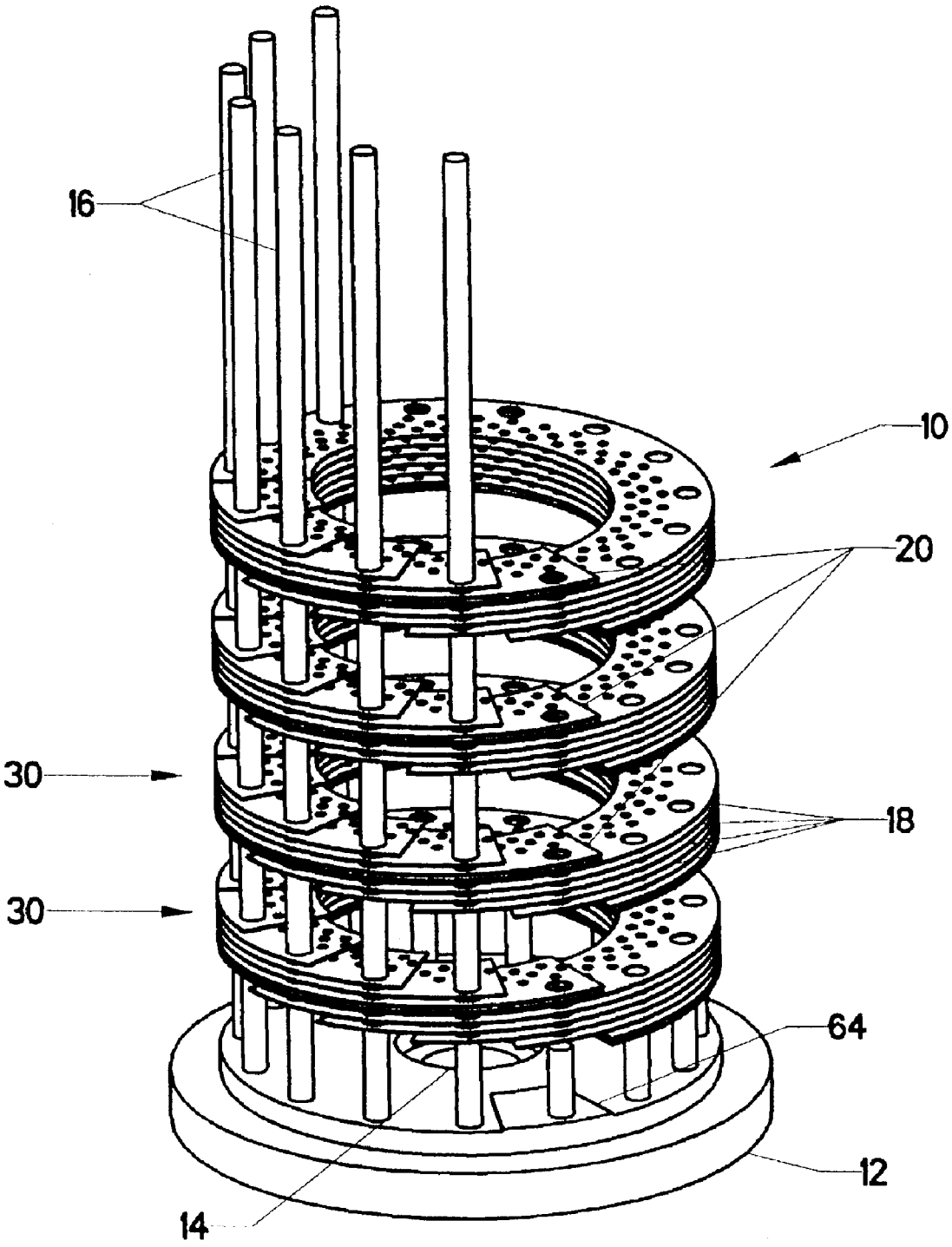
FIG. 1 (PRIOR ART)
FIG. 1 is an isometric view, showing a prior art Bitter magnet.
Figure 1B:
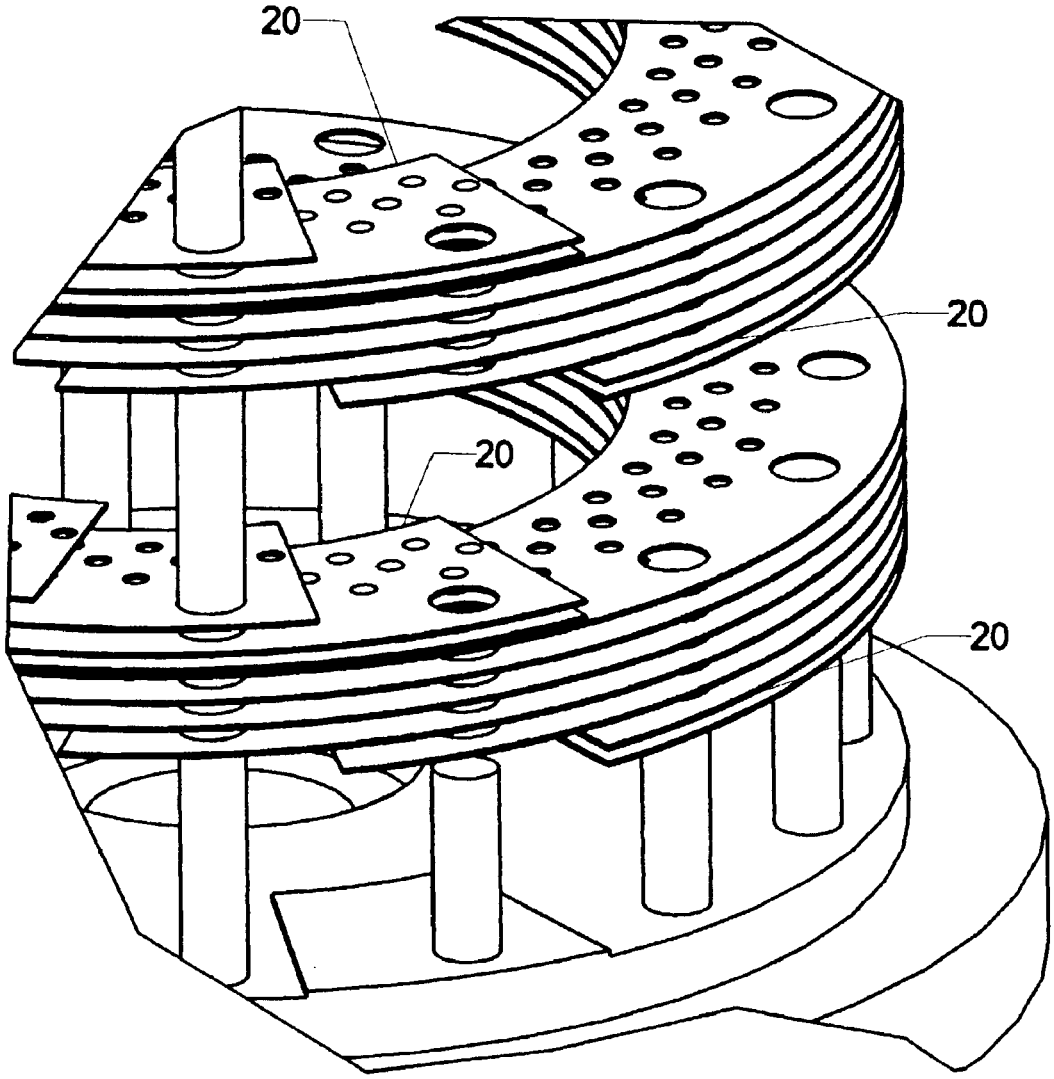
FIG. 1 B (PRIOR ART)
FIG. 1B is a detail view, showing a prior art Bitter magnet.
Figure 2:
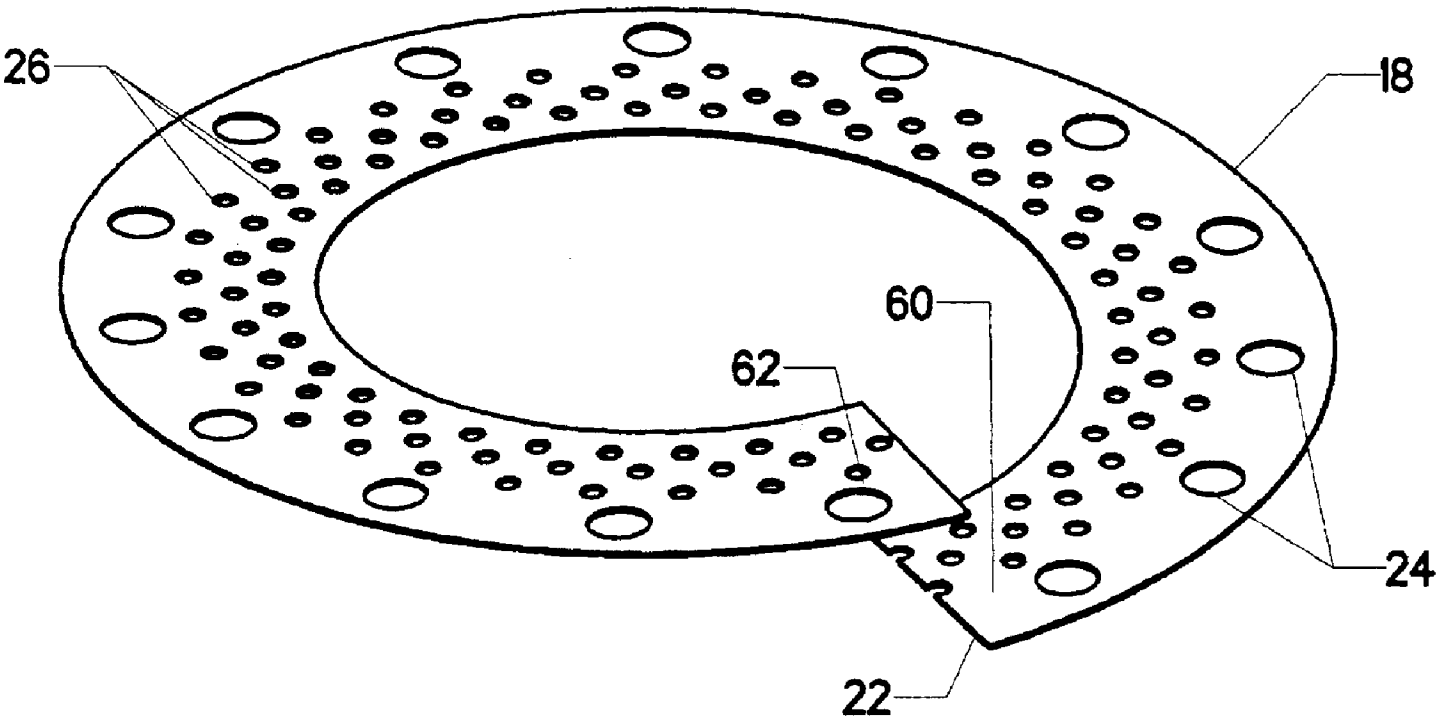
FIG. 2 (PRIOR ART)
FIG. 2 is an isometric view, showing a prior art conducting disk.
Figure 3:
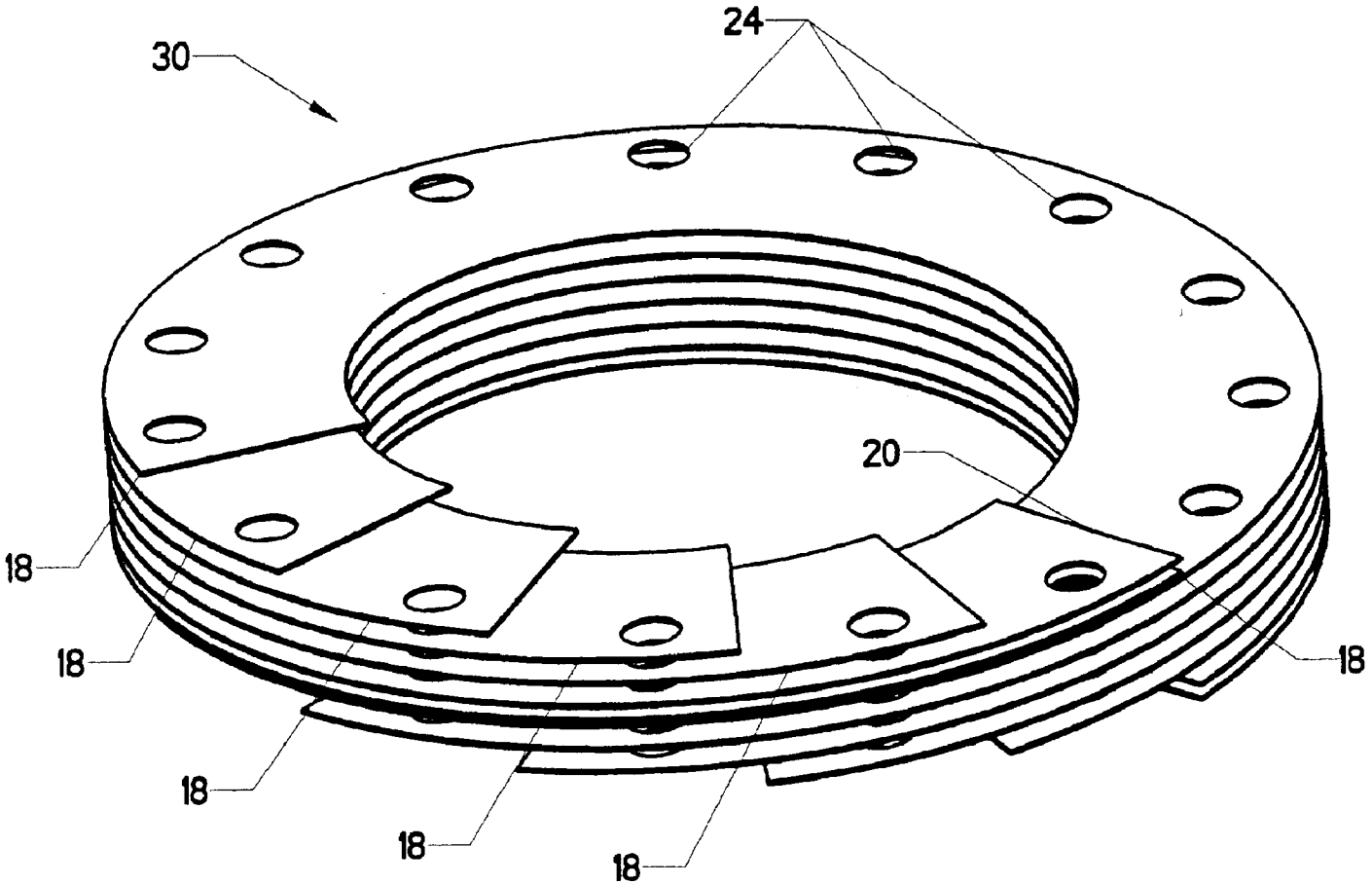
FIG. 3 (PRIOR ART)
FIG. 3 is an isometric view, showing a prior art conductor stack.
Figure 4:
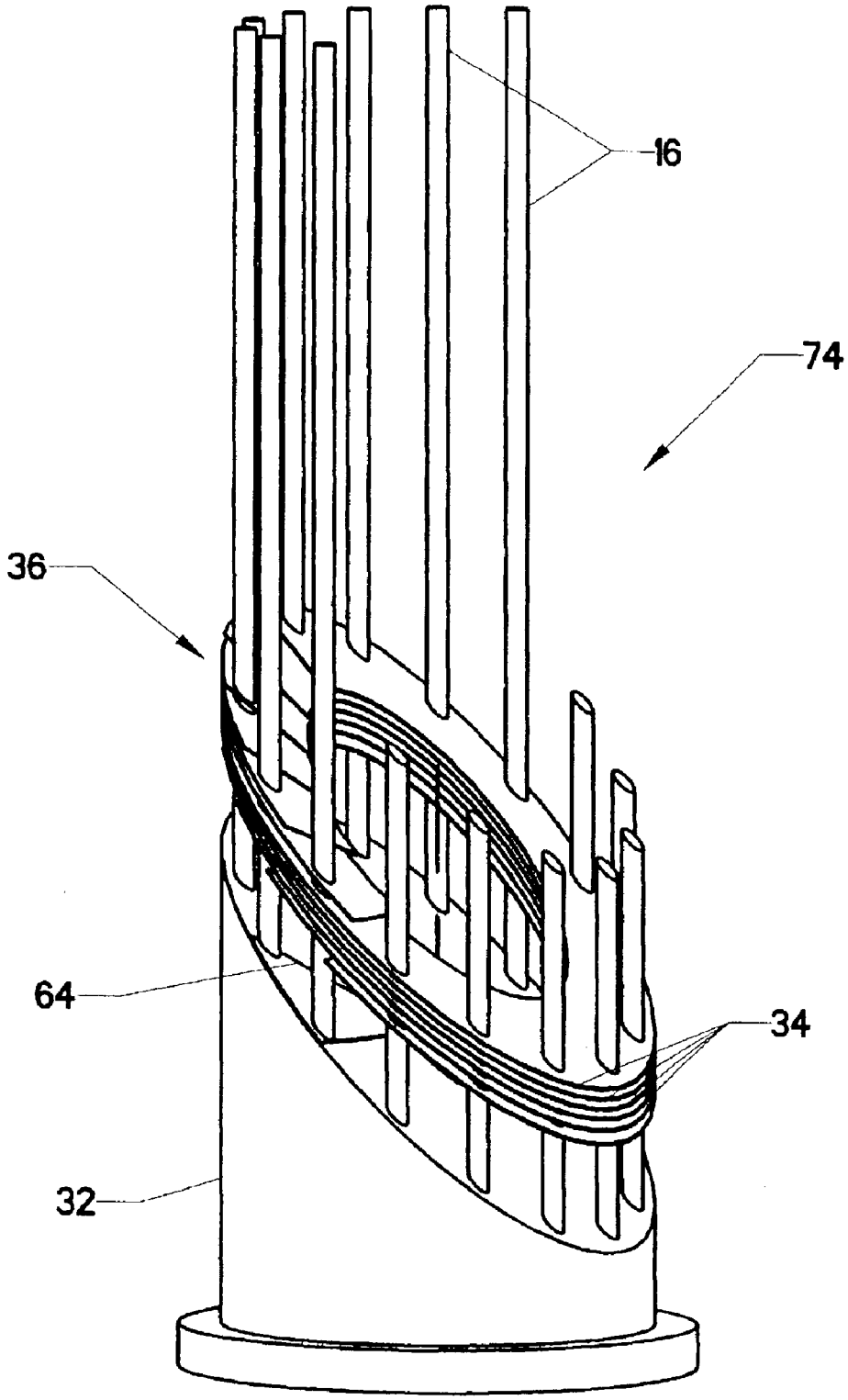
FIG. 4 is an isometric view, showing the proposed invention.

FIG. 4 depicts one possible way to physically construct the proposed invention. Angled end plate 32 is substituted for the conventional end plate 12. 45° conducting disks 34 are placed onto tie rods 16 in the same manner as for the prior art device (including the rotational indexing). The reader will note, however, that 45° conducting disks 34 form a current loop which is offset 45° from the center axis of transverse field Bitter magnet 74. The six 45° conducting disks 34 combine to form 45° conductor stack 36. A series of alternating insulating disks and 45° conductor stacks are added to 45° conductor stack 36 shown to build a laminated assembly similar to the prior art device—with one critical distinction: the current flowing through the device still flows in a helix, but the arcs within the helix the offset 45° from the center axis of the device.

Figure 5:
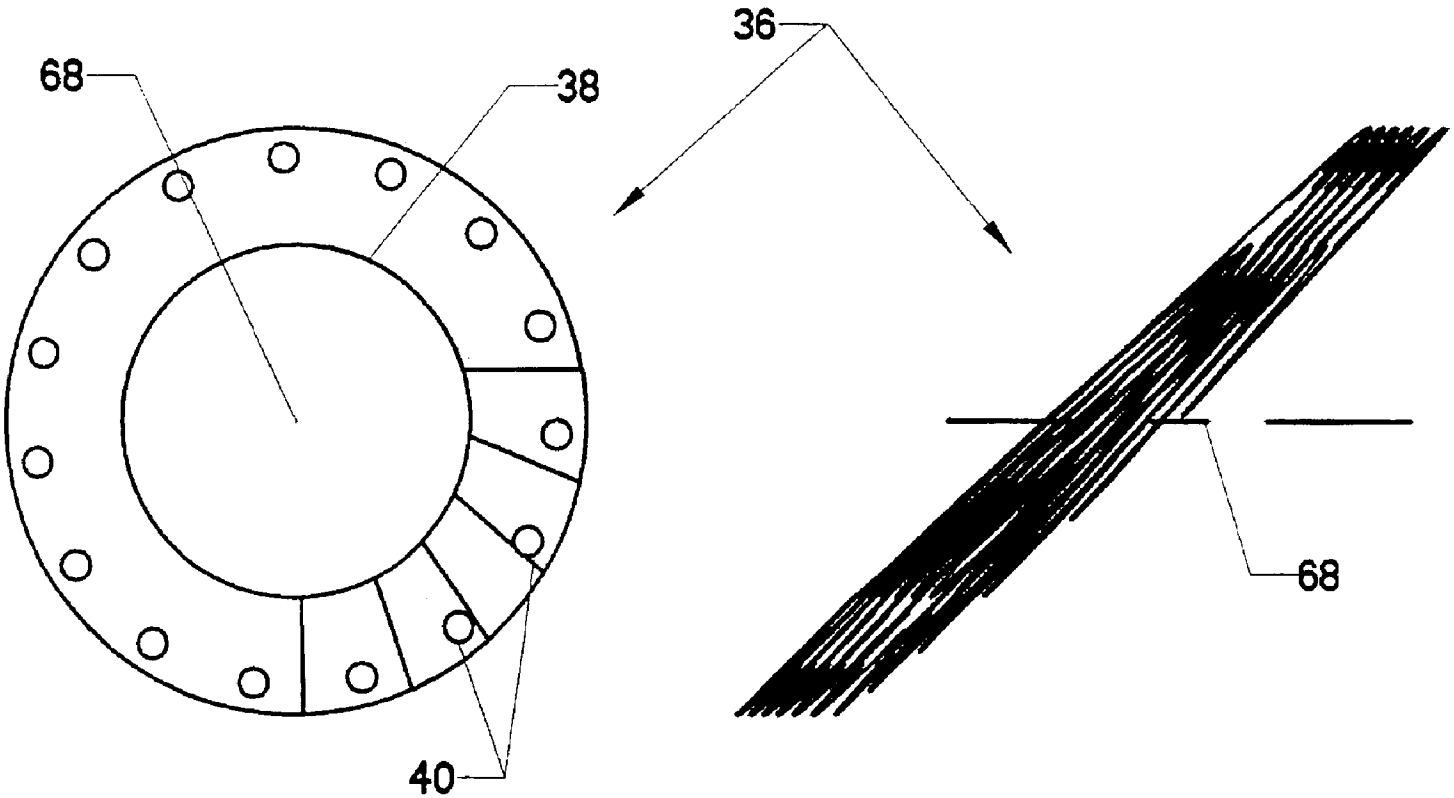
FIG. 5 comprises two orthogonal views, illustrating the nature of the 45° conductor stack.

FIG. 5 is presented to clearly show this angular offset. The lefthand view in FIG. 5 corresponds to looking straight down on 45° conductor stack 36 from directly above the device shown in FIG. 4. The reader will note that projected center bore 38 is perfectly circular. Likewise, projected tie rod holes 40 are perfectly circular. Thus, 45° conductor stack 36 fits securely within a cooling jacket similar to the one described for the prior art device. It can also fit over tie rods 16.

Figure 6:
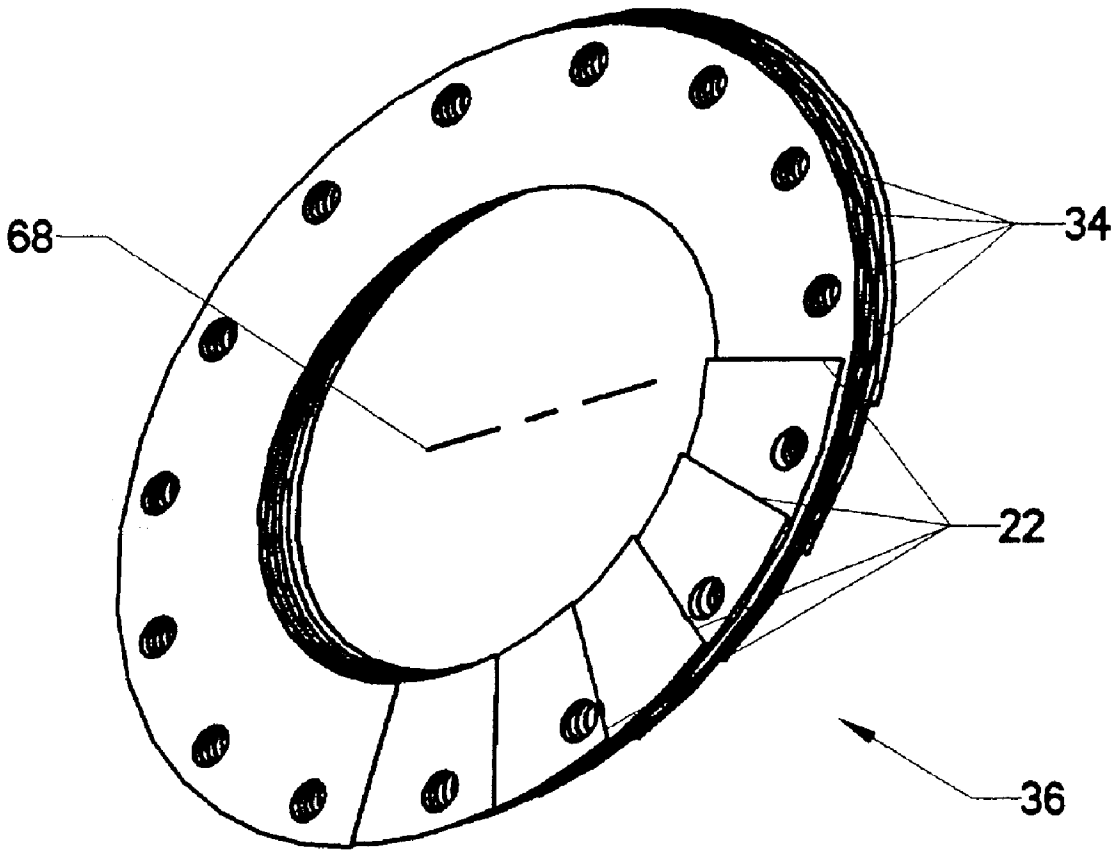
FIG. 6 is an isometric view, showing the 45° conductor stack.

The right-hand view shown in FIG. 5 corresponds to a right side view of 45° conductor stack 36. The reader will observe that the stack forms a helix, but one which is offset 45° from center axis 68. FIG. 6 is an isometric view showing 45° conductor stack 36. The stack is rotationally indexed, as shown by the displacement in successive cuts 22. Like the prior art device, tie rod holes 24 in successive 45° conducting disks align. Cooling holes are also present in these disks, and they also align. For purposes of visual simplicity, they have not been illustrated.

Figure 6B:
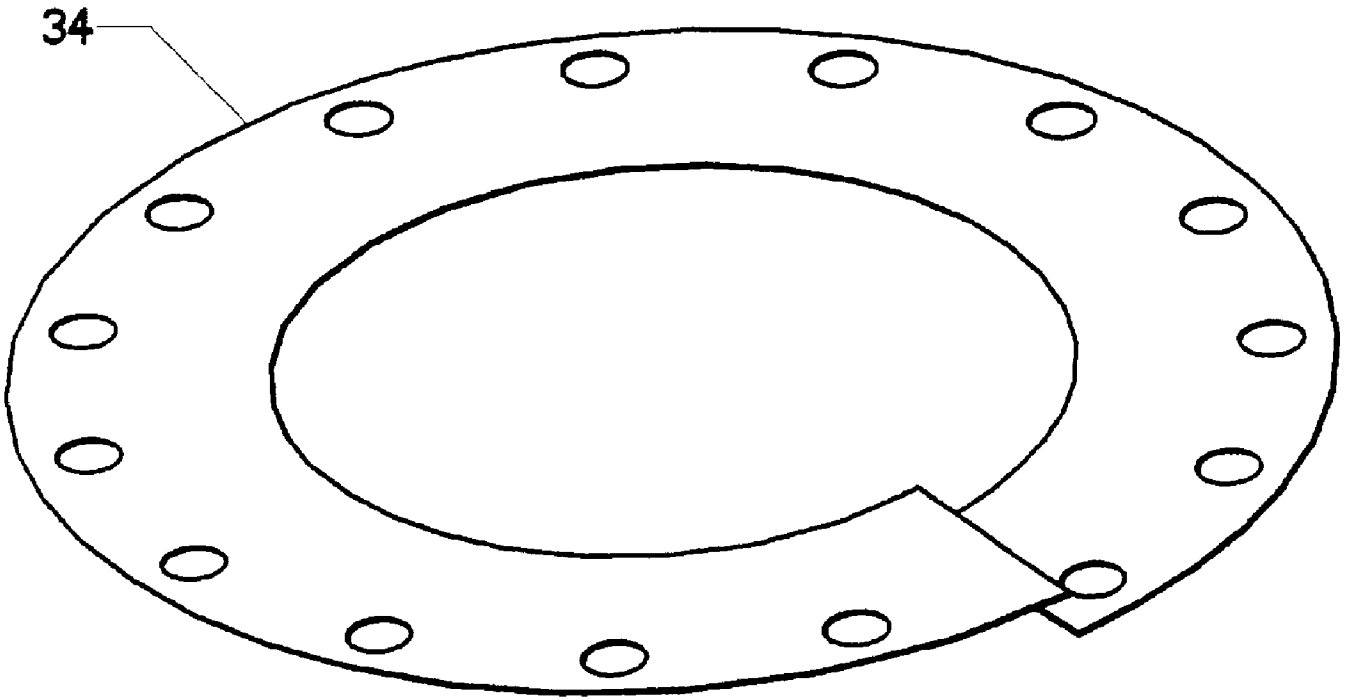
FIG. 6B is an isometric, showing a single 45° conducting disk.
Figure 6C:
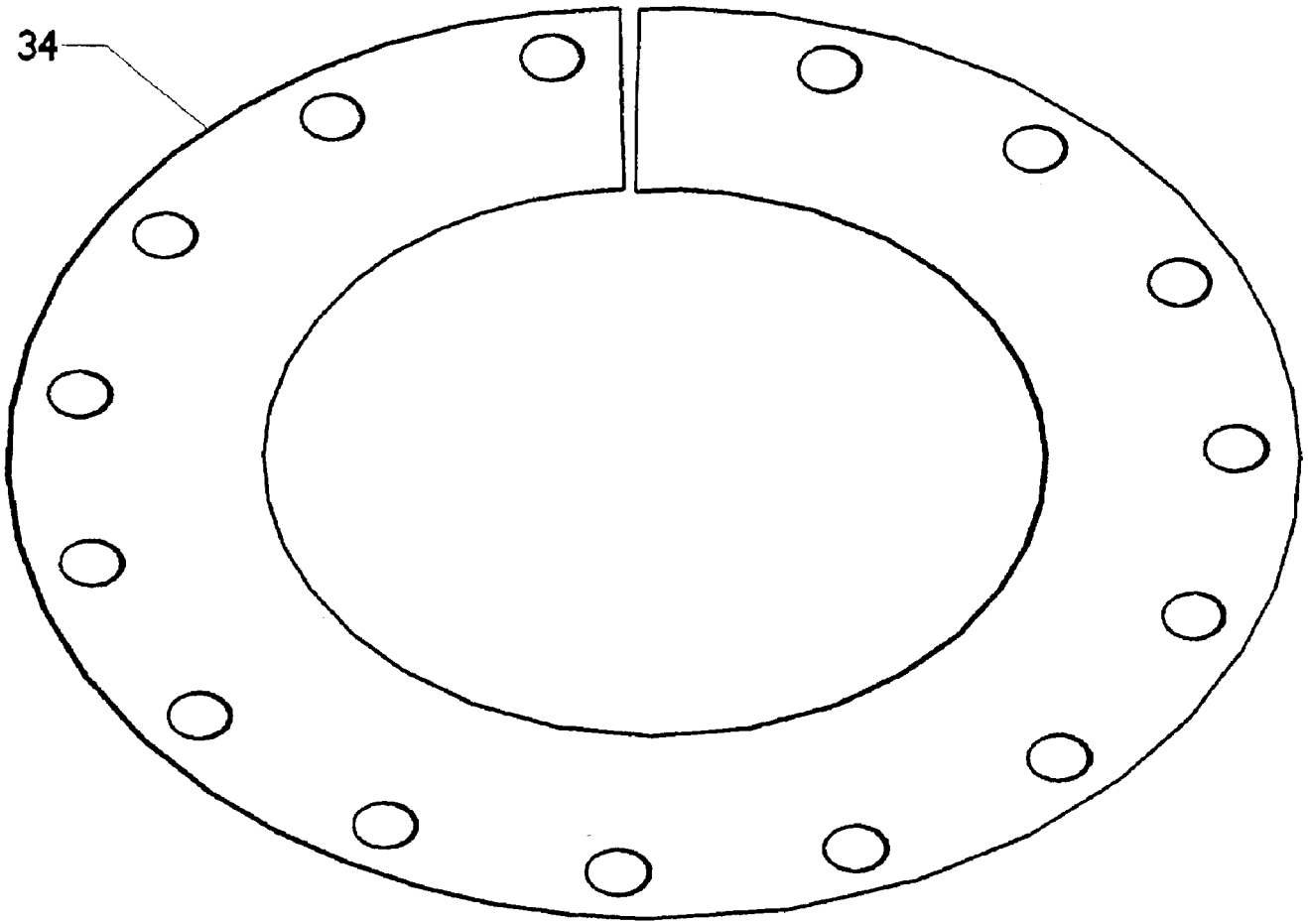
FIG. 6C is a plan view, showing a single 45° conducting disk.

FIG. 6B shows a single 45° conducting disk 34. Its features are generally similar to those found in the prior art device, including the cut producing a shallow helical shape. However, as those skilled in the art will appreciate, 45° conducting disk 34 does not have a circular shape. FIG. 6C shows a 45° conducting disk 34 in a plan view. The reader will observe that both its inner and outer perimeters have an elliptical shape. This shape is used, so that when the disk is tilted 45° in its installation, the inner and outer perimeters will project along the center bore of the Bitter magnet as pure circles. If a disk shape other than elliptical is used, the inner and outer perimeters will project as something other than a pure circle.

All of the preceding description has been presented so that the reader may: (1) understand the construction of Bitter-type magnets; and (2) understand how the current flow in such a magnet can be forced to assume a path which is angularly offset from the center axis of the magnet. These principles will now be employed to describe some of the novel features of the present invention.

Figure 7:
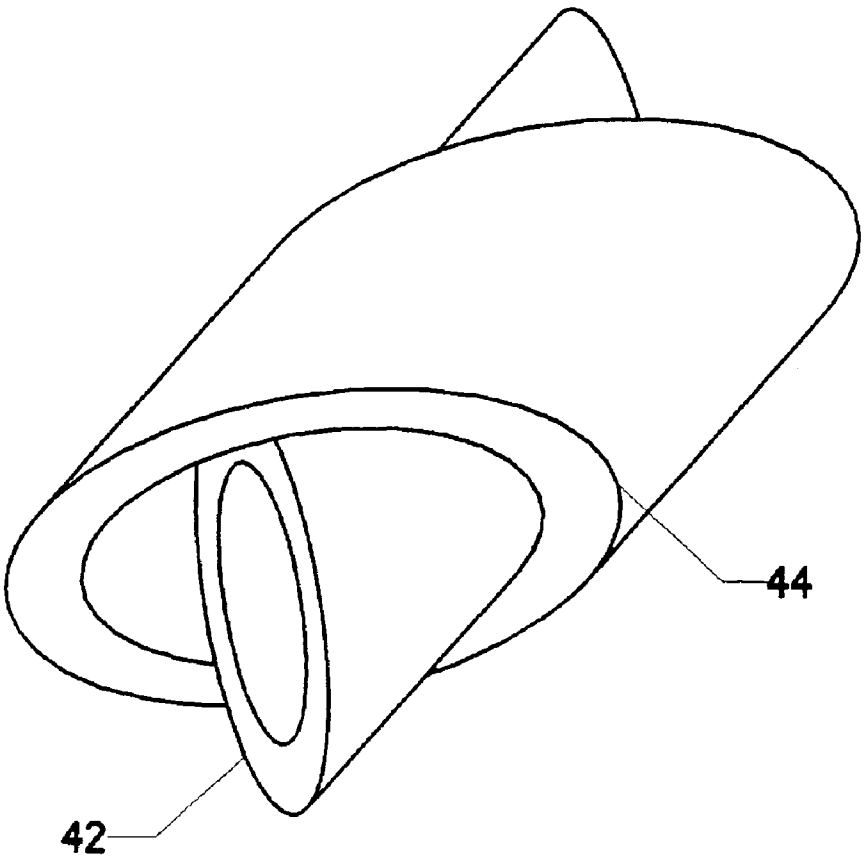
FIG. 7 is an isometric view, showing a simplified representation of a nested pair of Bitter coils.
Figure 8:
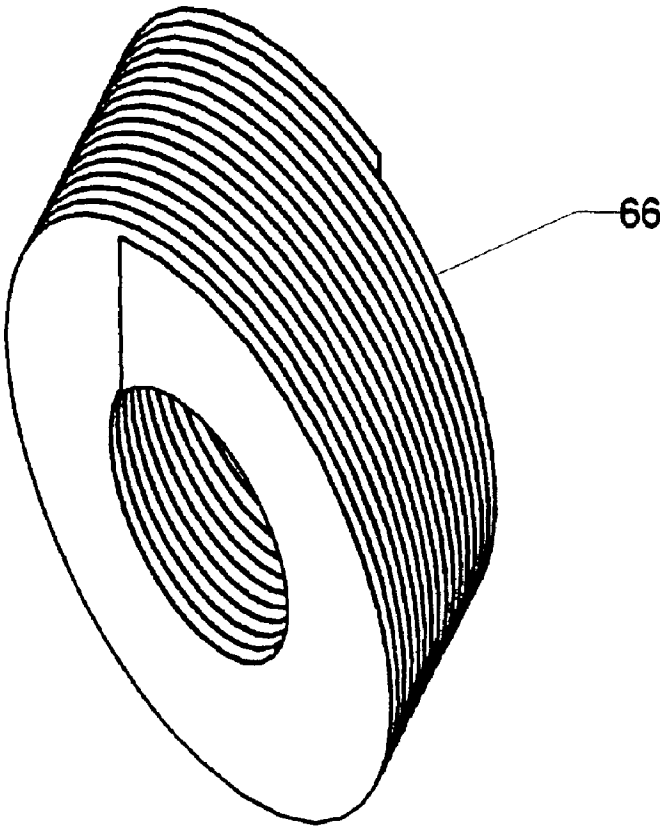
FIG. 8 is an isometric view, showing the helical nature of the current flow through the coils shown in FIG. 7.

FIG. 7 depicts a nested pair of transverse field Bitter coils. Second Bitter coil 44 fits around first Bitter coil 42. Both coils are shown as simplified representations. The reader should understand that to physically realize these coils would require the type of structures disclosed in FIGS. 4–6. However, for the present purposes, it is sufficient to understand that the current path in each of these coils follows an angularly offset helix. In other words, although the coils are depicted as solid objects, they are in fact comprised of stacks of 45° conducting disks 34. FIG. 8 depicts the nature of the current path in first Bitter coil 42—indicated as simplified helix 66.

Figure 9:
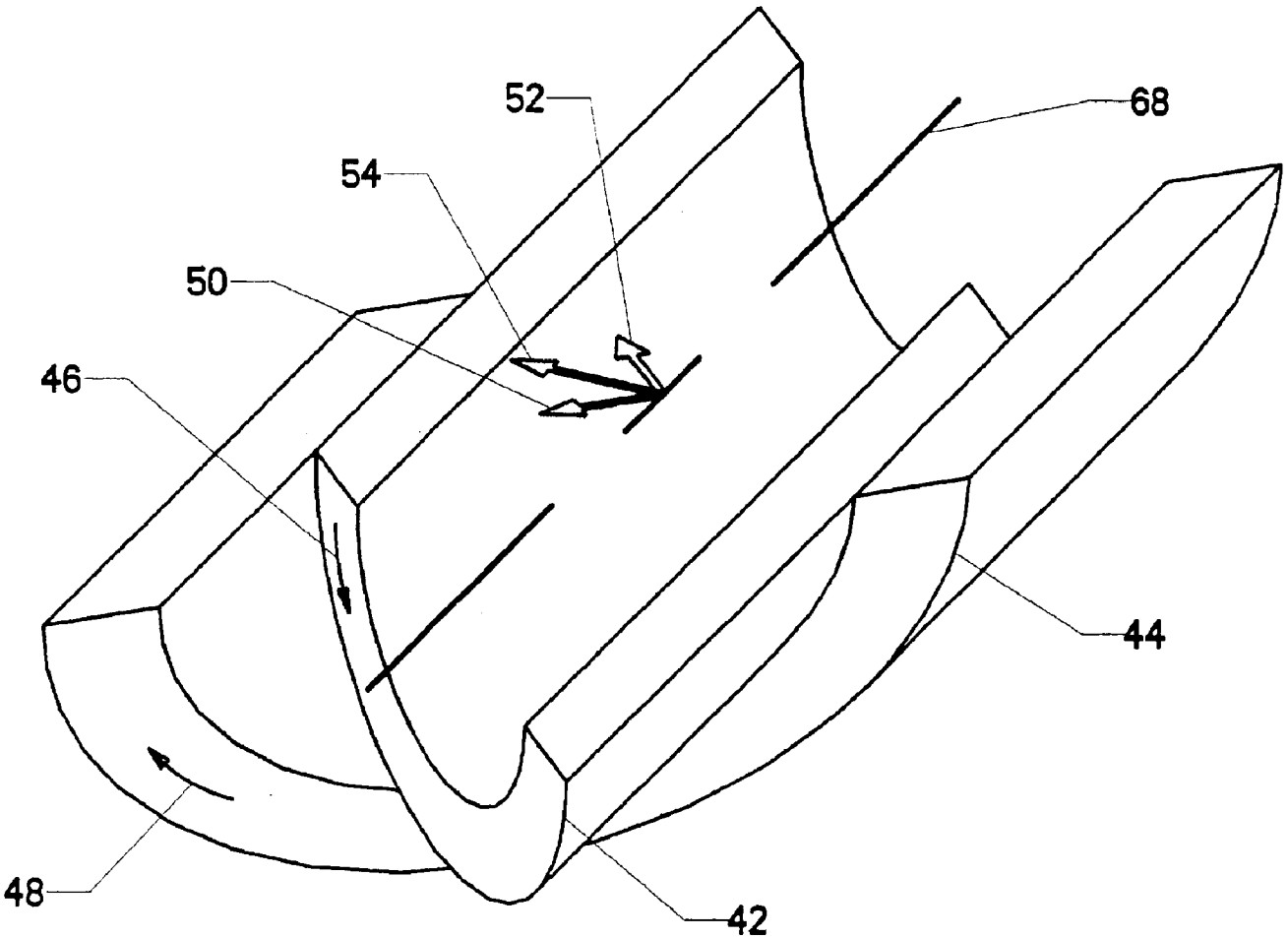
FIG. 9 is an isometric view with a cutaway, showing the magnetic fields induced by the nested pair of Bitter coils.

FIG. 9 shows the nested pair with a cutaway to aid visualization. First Bitter coil 42 is energized so that first coil current 46 flows in a counterclockwise direction (when viewed down center axis 68 from the left hand side). Of course, the reader should recall that the current loops within Bitter coil 42 are angularly offset 45° from center axis 68. The result of the current flow is first induced field 50. The direction of first induced field 50 corresponds to the current flow within first Bitter coil 42, according to the right-hand rule.

Second Bitter coil 44 is energized so that second coil current 48 flows in a clockwise direction when viewed down center axis 68 from the left hand side. The result of second coil current 48 is second induced field 52. The orientation of second induced field 52 is angularly displaced 90° from first induced field 50, via application of the right-hand rule.

Figure 10:
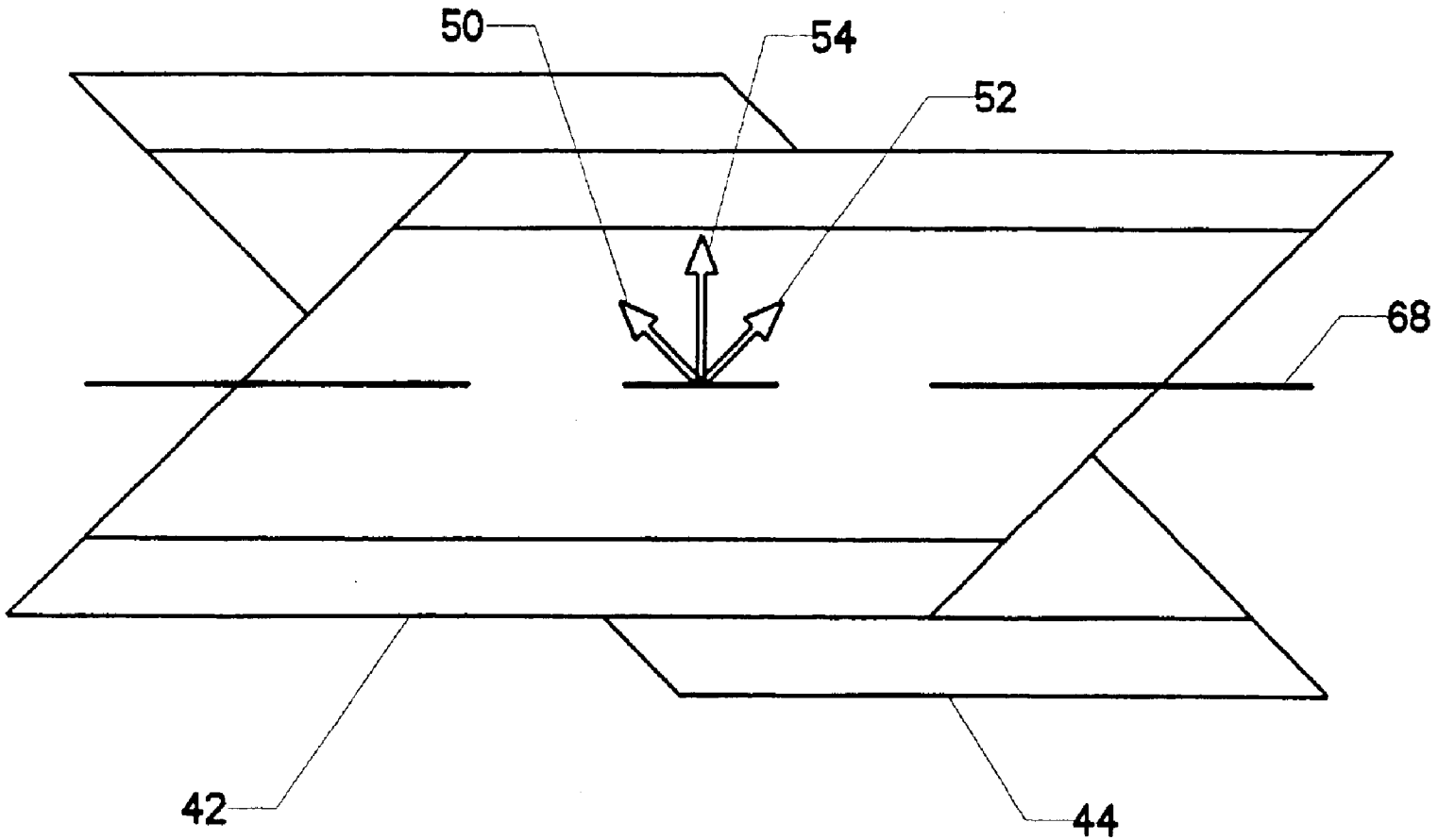
FIG. 10 is a plan view, showing the magnetic fields induced by the nested pair of Bitter coils.

FIG. 10 shows the same assembly in a plan view. Those skilled in the art will realize that by carefully designing the structure of the two Bitter coils and carefully regulating the current flowing therein, it is possible to make the strength of first induced field 50 match the strength of second induced field 52. When this occurs the components of first induced field 50 and second induced field 52 which lie along center axis 68 will cancel each other out. Resultant field 54 will remain, which is in an orientation that is transverse to center axis 68. Thus, by carefully designing the nested pair of Bitter coils, it is possible to produce a magnetic field which is purely transverse to center axis 68.

Those skilled in the art will also realize that the direction of current flow within the two nested coils may be arbitrarily selected—so long as the currents in the two coils flow in opposite directions. Thus, by reversing the current flow in the two coils, it is possible to create a transverse magnetic field in either direction (straight up or straight down as viewed in FIG. 10).

Figure 11:
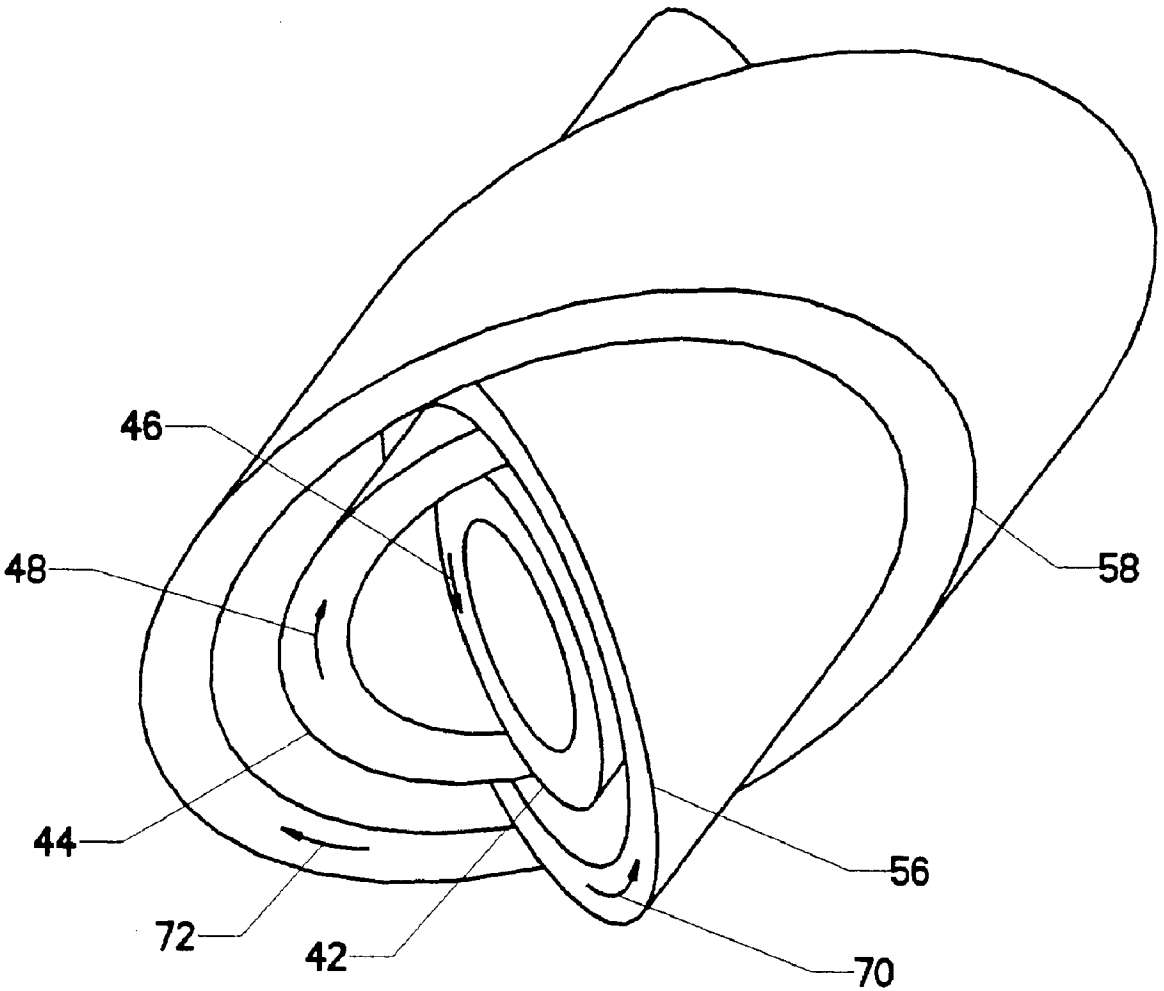
FIG. 11 is an isometric view, showing a simplified representation of four nested Bitter coils.

FIG. 11 depicts a set of four nested Bitter coils which carries the concept further. Third Bitter coil 56 and fourth Bitter coil 58 are added around the pair of Bitter coils described in FIGS. 7 through 10. Although they are again illustrated in simplified form, their structure corresponds to that shown in FIGS. 4 through 6.

Third Bitter coil 56 is energized so that third coil current 70 flows in a counterclockwise direction when viewed along center axis 68 from the left hand side. Fourth Bitter coil 58 is energized so that fourth coil current 72 flows in a clockwise direction. This current flow produces additional induced fields like those illustrated in FIG. 10. By carefully designing the third and fourth Bitter coils to match each other, the components of the induced fields produced by the third and fourth Bitter coils which lie along center axis 68 will again cancel each other out. The transverse component, however, will serve to intensify the transverse magnetic field created by the first two nested Bitter coils. Thus, it is possible by nesting additional Bitter coils, to further strengthen the purely transverse magnetic field created by the first two Bitter coils. Furthermore, designs can be created wherein consecutive coils can have the same orientation and current direction.

Figure 12:
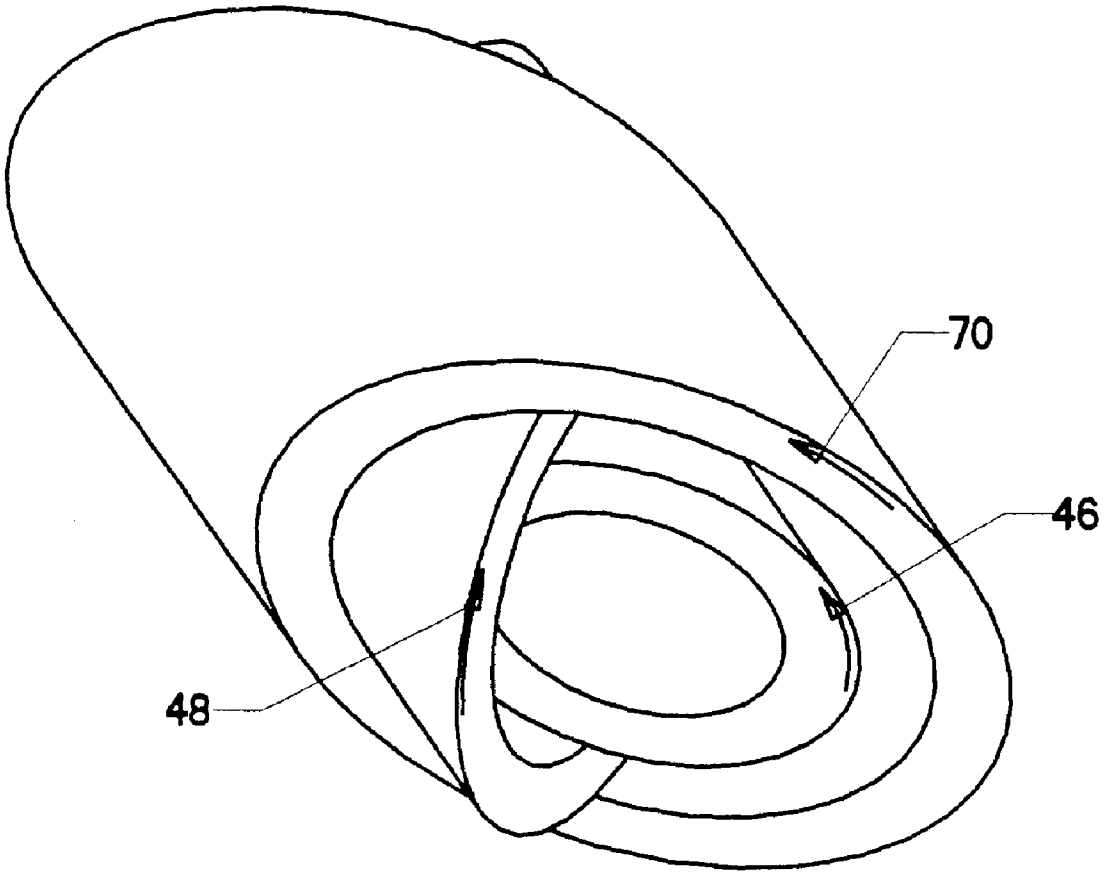
FIG. 12 is an isometric view, showing a simplified representation of three nested Bitter coils.

The reader should appreciate that the invention is not limited to an even numbers of nested coils. FIG. 12 shows an odd-numbered configuration. First coil current 46 and third coil current 70 flow in the same direction. Second coil current 48 flows in the opposite direction. The result of this arrangement is a field which is angularly offset from the central bore of the magnet, and which cab be aligned to any desired orientation (including 90 degrees). Using an odd number of nested coils along with variations in the current flow can produce a field having an arbitrary angular offset from the central bore. Thus, not only can the present invention produce a purely transverse field, it can also produce a field having any desired angular offset from the central bore.

Figure 13:
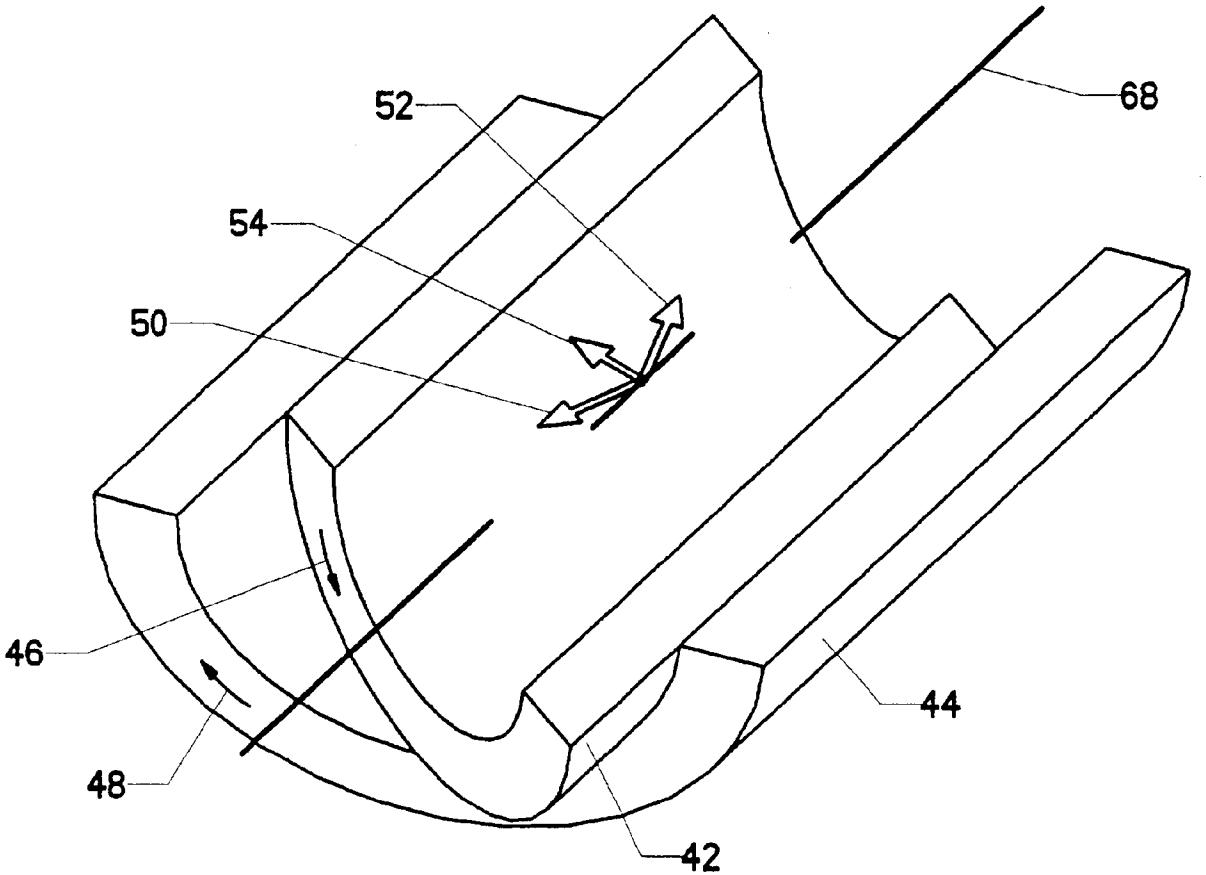
FIG. 13 is an isometric view, showing a pair of 20° nested coils.
Figure 14:
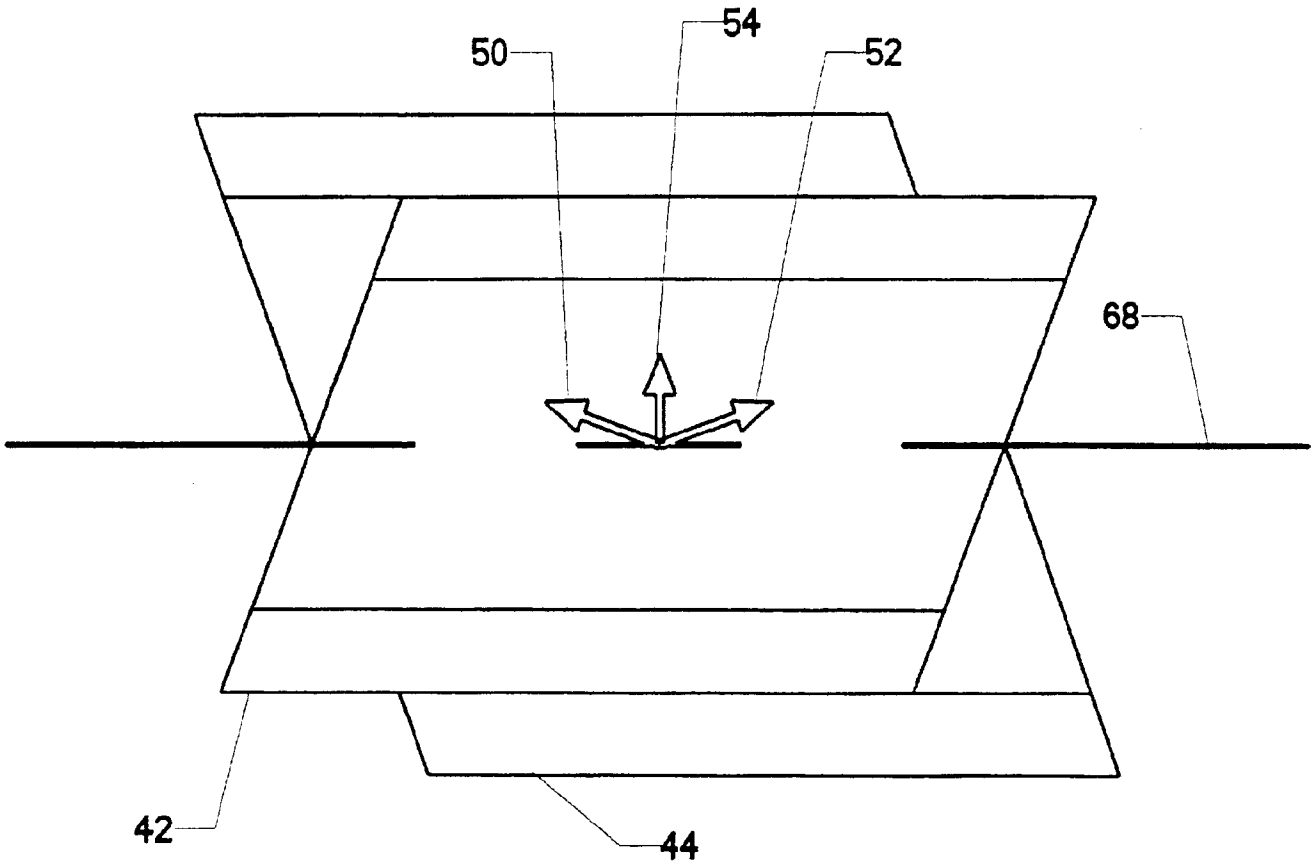
FIG. 14 is a plan view, showing a pair of 20° nested coils.

Likewise, although coil stacks having a 45 degree offset have been used for purposes of illustration, the invention is not limited to this type. FIG. 13 shows a pair of nested coils having a 20 degree angular offset (The top half of the coils are again cut away to aid visualization). Like the example shown in FIG. 9, first coil current 46 flows in the opposite direction of second coil current 48. First coil current 46 creates first induced field 50, as graphically shown by the vector arrow. Second coil current 48 creates second induced field 52. Referring now to FIG. 14, the reader will observe that the components of the two induced fields lying along center axis 68 cancel each other out, leaving resultant field 54 (which is again purely transverse). Thus, those skilled in the art will realize that the angular offset for the coils is not critical to producing the transverse field, although it has an obvious effect on the strength of the transverse field.

Figure 15A:
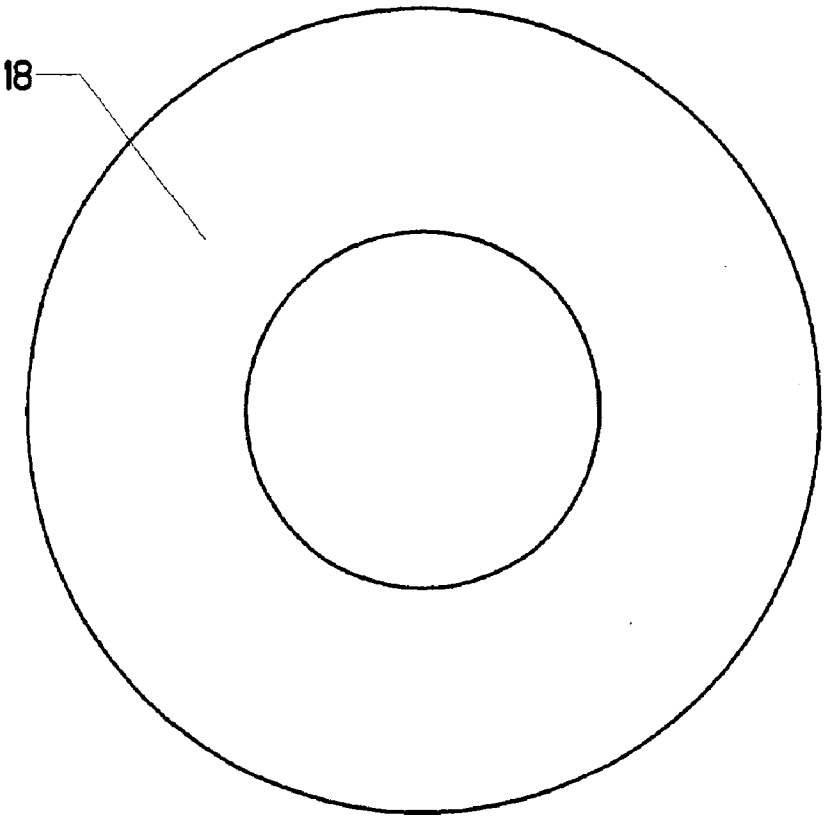
FIG. 15A is an isometric view, showing a circular conducting disk.
Figure 15B:
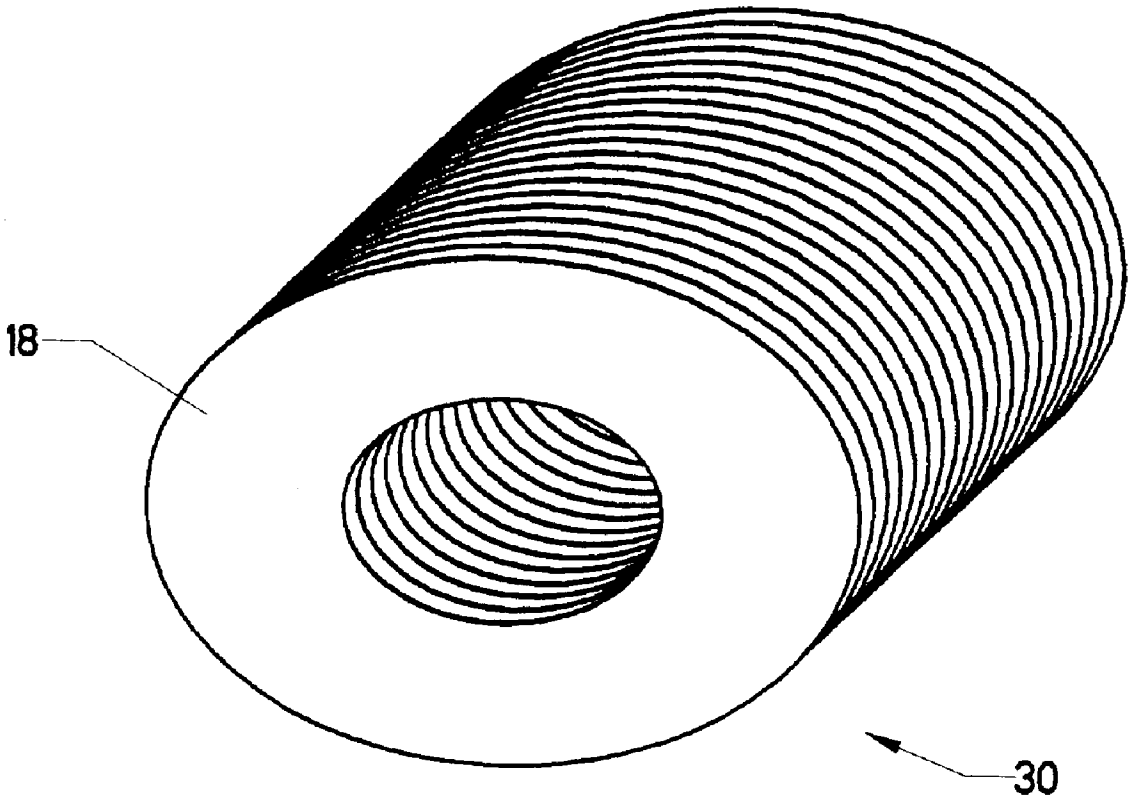
FIG. 15B is an isometric view, showing an angularly-offset conduct stack made from circular disks.
Figure 15C:
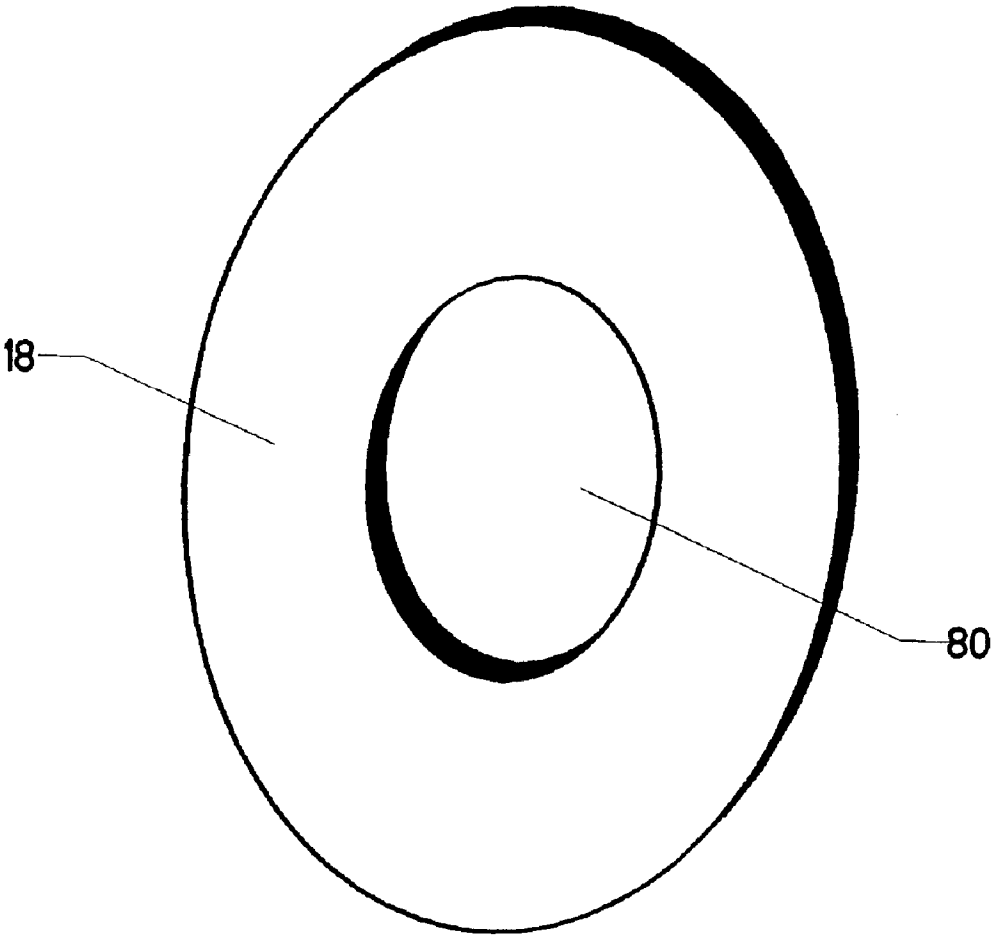
FIG. 15C is an isometric view, showing the elliptical nature of the center bore formed by circular disks.

The previous examples have used elliptical disks so that when they are angularly offset a cylindrical bore will be produced. While such a design has its advantages, the invention can certainly be practiced using non-elliptical conductor disks. FIG. 15A shows a perfectly circular conductor disk 18 (Compare the elliptical conductor disk 18 shown in FIG. 6C). Detailed features of the disk—such as the radial slit, mounting holes, and cooling holes—have been omitted for simplicity. FIG. 5B shows a conductor stack 30 made from a series of angularly offset conductor disks 18. Insulating and other features would be included to force a helical current flow through the stack, similar to the flow shown in FIG. 8. However, because circular disks are used, the shape created by the stack will not be cylindrical. FIG. 15C shows a view which is only slightly offset from the center bore. In this view, the reader will observe that elliptical bore 80 is formed by stacking the circular disks using the angular offset. Thus, the reader will appreciate that the invention is by no means confined to the use of elliptical disks.

Figure 16:
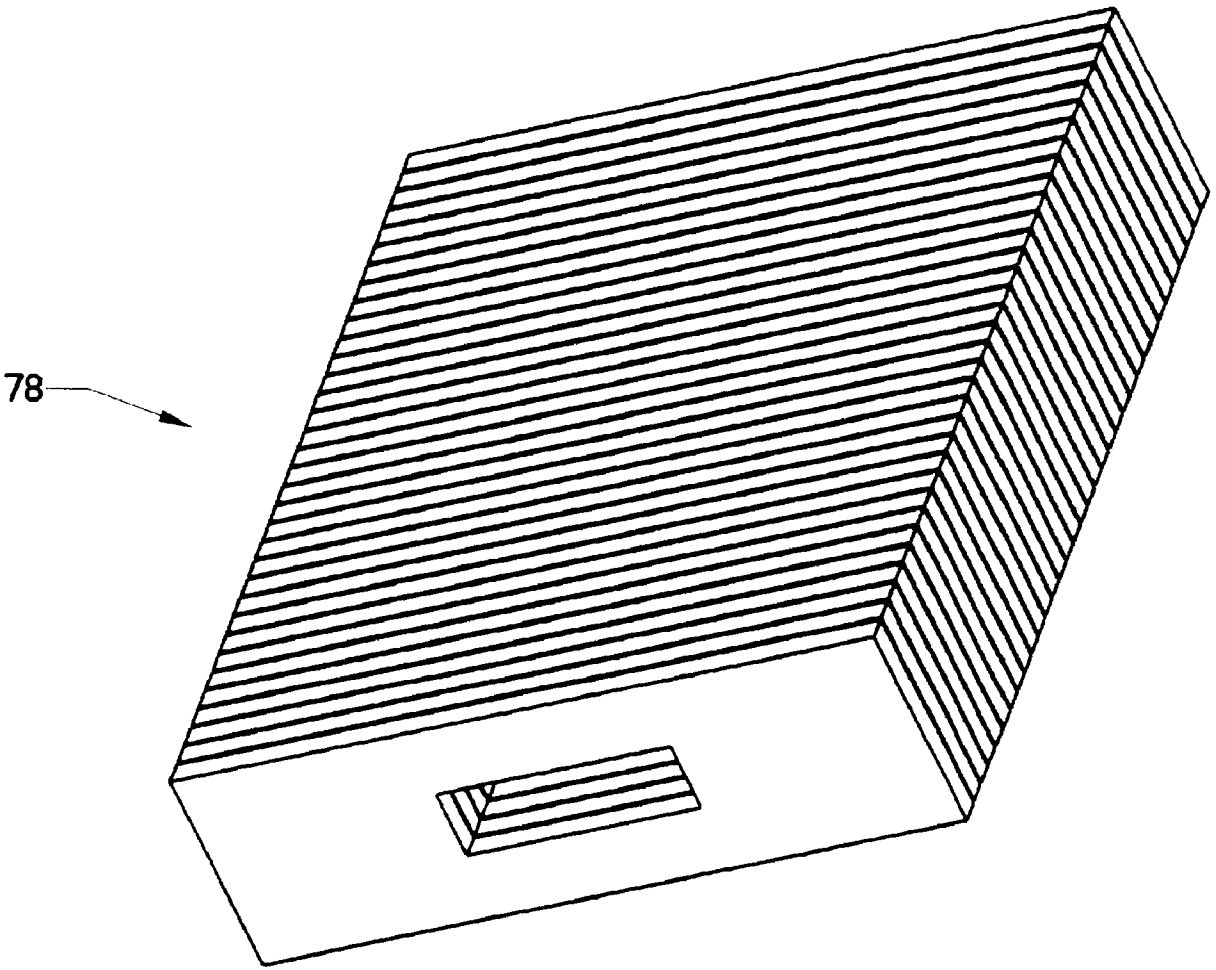
FIG. 16 is an isometric view, showing a non-circular variant.

In fact, non-curved shapes can also be employed. FIG. 16 shows a square disk stack 78 formed by angular offsetting a stack of square conductors. The current path through this stack is again helical, but the center "bore" is rectangular.

Figure 17:
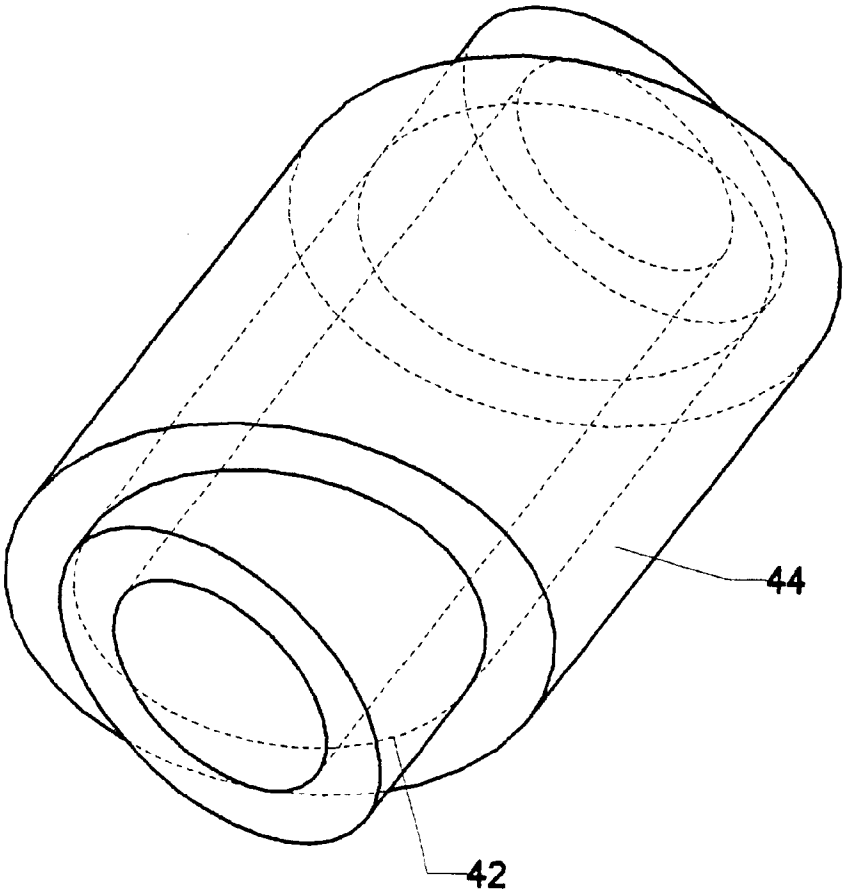
FIG. 17 is an isometric view, showing two nested non-matched coils.

Finally, although most of the examples presented have been configured to create a purely transverse field, the invention is not limited to such a field. In some instances, it may be desirable to create a field with transverse and aligned components (where the term "aligned" means aligned with the center bore of the conductor stack). This can be accomplished via mixing different types of coils. FIG. 17 shows such a magnet, where first bitter coil 42 has a different angle of inclination that second bitter coil 44.

The magnets disclosed can also be switched to oscillate between conventional and transverse fields. Returning briefly to FIG. 13, the reader will recall that the two coils were energized using current flowing in opposite directions (first coil current 46 and second coil current 48). Switching means can be used to make the two coil currents flow in the same direction. By proper tuning of these currents and the coil geometry, a purely aligned field can be created. A brief look at FIG. 14 will confirm this fact to those skilled in the art. Reversing the current in second bitter coil 44 will shift the orientation of second induced field 52 by 180 degrees. The transverse components of first induced field 50 and second induced field 52 will then cancel each other out, leaving a field aligned with center axis 68. Thus, switching the current direction in one of the coils can switch the magnet from a purely transverse field to a purely aligned one. More complicated permutations are possible with the addition of more coils. Switching the current direction in a magnet such as shown in FIG. 11, as one example, can produce a variety of combined transverse and aligned fields.

Figure 18:
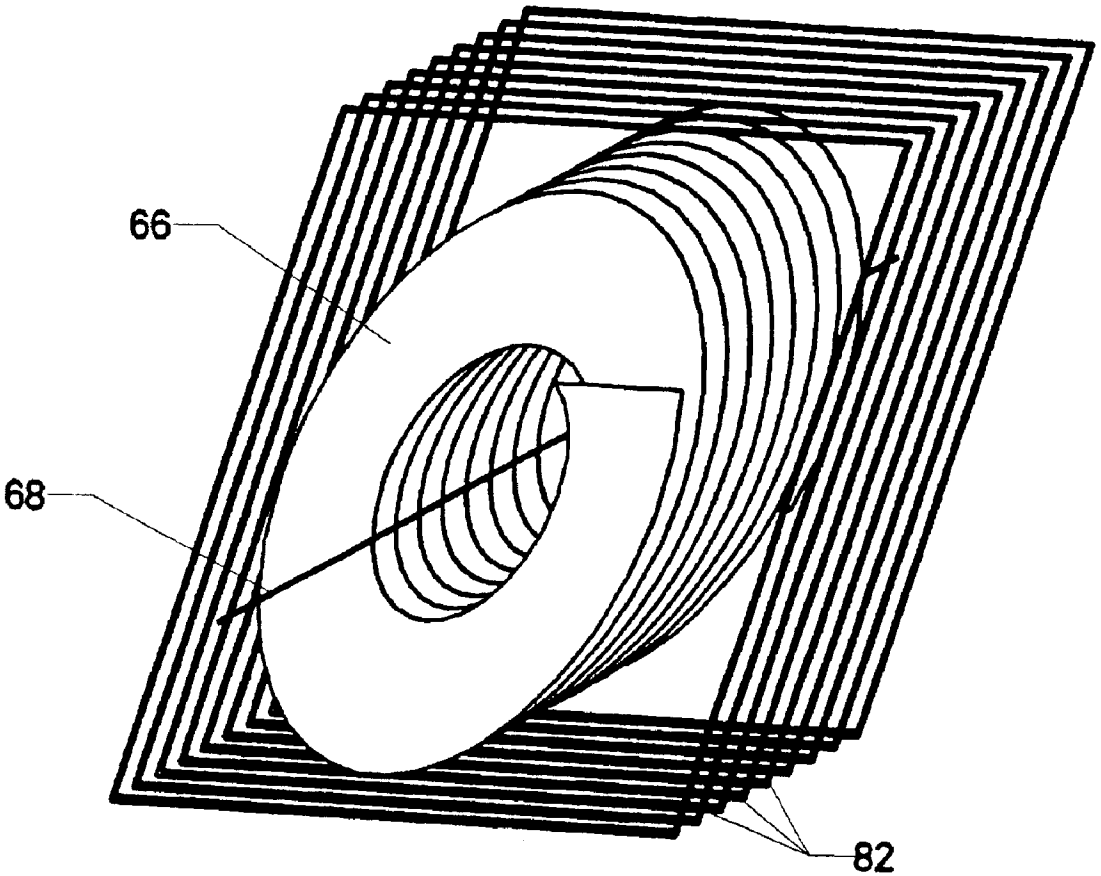
FIG. 18 is an isometric view, showing how each turn of a coil lies approximately in one plane.

The invention broadly encompasses helical coils in which each turn of the helix is angularly displaced (to 45 degrees, 30 degrees, or other desired orientation). FIG. 18 shows simplified helix 66. Each turn of the helix lies approximately in one plane. The word "approximately" is used because, of course, a helix does not truly lie in a single plane (Observe the right view of FIG. 5). However, each turn is centered about one plane. The planes for each turn of the illustrated helix are designated as theoretical turn planes 82 in the view. The reader will observe that these planes are a series of inclined and parallel planes, each offset a fixed distance from its neighbor. These planes are inclined from center axis 68 a fixed amount.

Figure 19:
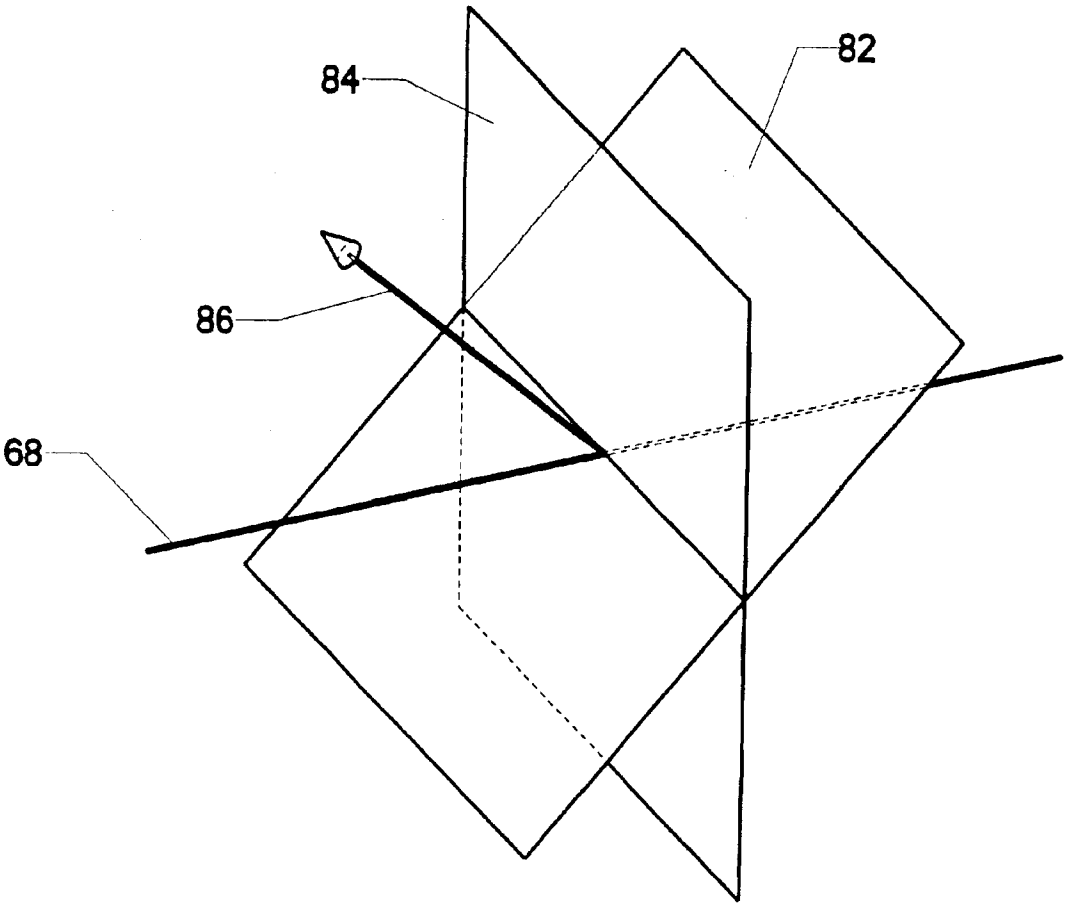
FIG. 19 is an isometric view, showing a general representation of an angularly offset coil.

FIG. 19 shows this inclination more clearly. The leading theoretical turn plane 82 is shown. Perpendicular plane 84 is a plane which is perpendicular to center axis 68, and which intersects center axis 68 at the same point as theoretical turn plane 82. A prior art helical conductor would have theoretical turn planes parallel to perpendicular plane 84. The present invention is distinguished by the fact that its turns are inclined. Turn plane normal vector 86 is perpendicular to theoretical turn plane 82. The angle between this vector and center axis 68 represents the inclination of the inclined turns from the conventional orientation found in the prior art.

Although the preceding description contains significant detail it should not be viewed as limiting the scope of the invention but rather as providing illustrations of the preferred embodiments. Accordingly, the scope of the invention should be set by the following claims rather than by the examples given.

Having described our invention, we claim:

1. An electromagnet capable of creating an angularly displaced magnetic field, comprising:

a. a center axis running from a first end of said electromagnet to a second end of said electromagnet;

b. a central cavity, lying within said electromagnet and running along said center axis;

c. a helical conductor, wrapped around said central cavity, wherein said helical conductor is formed by a plurality of 360 degree turns;

d. wherein each of said plurality of turns lies approximately in one of a plurality of offset parallel planes; and e. wherein a normal vector for each of said plurality of offset parallel planes is angularly displaced from said center axis.

2. An electromagnet capable of creating an angularly displaced magnetic field, comprising:

a. a first coil, including i. a first center axis running from a first end of said first coil to a second end of said first coil;

ii. a central cavity, lying within said first coil and running along said first center axis;

iii. a first helical conductor, wrapped around said central cavity, wherein said first helical conductor is formed by a plurality of 360 degree turns;

iv. wherein each of said plurality of turns lies approximately in one of a first plurality of offset parallel planes;

v. wherein a normal vector for each of said first plurality of offset parallel planes is angularly displaced from said first center axis;

b. a second coil, including i. a second center axis running from a first end of said second coil to a second end of said second coil, wherein said second center axis is aligned with said first center axis;

ii. a second helical conductor, wrapped around said first coil, wherein said second helical conductor is formed by a plurality of 360 degree turns;

iii. wherein each of said plurality of turns lies approximately in one of a second plurality of offset parallel planes;

iv. wherein a normal vector for each of said second plurality of offset parallel planes is angularly displaced from said first center axis;

c. wherein an electrical current is caused to flow in a first direction within said first coil; and d. wherein an electrical current is caused to flow in a direction opposite to said first direction within said second coil.

3. An electromagnet as recited in claim 2, further comprising:

a. a third coil, including i. a third center axis running from a first end of said third coil to a second end of said third coil, wherein said third center axis is aligned with said first center axis;

ii. a third helical conductor, wrapped around said second coil, wherein said third helical conductor is formed by a plurality of 360 degree turns;

iii. wherein each of said plurality of turns lies approximately in one of a third plurality of offset parallel planes;

iv. wherein a normal vector for each of said third plurality of offset parallel planes is angularly displaced from said first center axis; and b. wherein an electrical current is caused to flow in said third coil in the same direction as said electrical current flowing within said first coil.

4. An electromagnet as recited in claim 3, further comprising:

a. a fourth coil, including i. a fourth center axis running from a first end of said fourth coil to a second end of said fourth coil, wherein said fourth center axis is aligned with said first center axis;

ii. a fourth helical conductor, wrapped around said third coil, wherein said fourth helical conductor is formed by a plurality of 360 degree turns;

iii. wherein each of said plurality of turns lies approximately in one of a fourth plurality of offset parallel planes;

iv. wherein a normal vector for each of said fourth plurality of offset parallel planes is angularly displaced from said first center axis; and b. wherein an electrical current is caused to flow in said fourth coil in the same direction as said electrical current flowing within said second coil.

5. An electromagnet as recited in claim 2, wherein the size of said first and second coils and the magnitudes of said electrical currents flowing in said first and second coils are configured so that said angularly displaced magnetic field created within said central cavity is a transverse magnetic field.

6. An electromagnet as recited in claim 3, wherein the size of said first, second, and third coils and the magnitudes of said electrical currents flowing in said first, second, and third coils are configured so that said angularly displaced magnetic field created within said central cavity is a transverse magnetic field.

7. An electromagnet as recited in claim 4, wherein the size of said first, second, third, and fourth coils and the magnitudes of said electrical currents flowing in said first, second, third, and fourth coils are configured so that said angularly displaced magnetic field created within said central cavity is a transverse magnetic field.

8. An electromagnet capable of creating an angularly displaced magnetic field, comprising:

a. a first coil, including i. a first center axis running from a first end of said first coil to a second end of said first coil;

ii. a central cavity, lying within said first coil and running along said center axis;

iii. a first helical conductor, wrapped around said central cavity, wherein said helical conductor is formed by a plurality of 360 degree turns;

iv. wherein each of said plurality of turns lies approximately in one of a first plurality of offset parallel planes;

v. wherein a normal vector for each of said first plurality of offset parallel planes is angularly displaced from said first center axis;

b. a second coil, including i. a second center axis running from a first end of said second coil to a second end of said second coil, wherein said second center axis is aligned with said first center axis;

ii. a second helical conductor, wrapped around said first coil, wherein said second helical conductor is formed by a plurality of 360 degree turns;

iii. wherein each of said plurality of turns lies approximately in one of a second plurality of offset parallel planes;

iv. wherein a normal vector for each of said second plurality of offset parallel planes is angularly displaced from said first center axis; and c. control means capable of causing an electrical current to flow in an arbitrary first direction within said first coil and capable of causing an electrical current to flow in an arbitrary second direction within said second coil, so that said angularly displaced magnetic field within said central cavity can be oriented in an arbitrary direction.

9. An electromagnet as recited in claim 8, wherein said control means is further capable of arbitrarily adjusting the magnitude of said electrical current within said first coil and the magnitude of said electrical current within said second coil, so that the strength of said magnetic field within said central cavity can be adjusted.

10. An electromagnet as recited in claim 8, further comprising:

a. a third coil, including i. a third center axis running from a first end of said third coil to a second end of said third coil, wherein said third center axis is aligned with said first center axis;

ii. a third helical conductor, wrapped around said second coil, wherein said third helical conductor is formed by a plurality of 360 degree turns;

iii. wherein each of said plurality of turns lies approximately in one of a third plurality of offset parallel planes;

iv. wherein a normal vector for each of said third plurality of offset parallel planes is angularly displaced from said first center axis; and b. wherein said control means is further capable of causing an electrical current to flow in an arbitrary third direction within said third coil, so that said angularly displaced magnetic field within said central cavity can be oriented in an arbitrary direction.

11. An electromagnet as recited in claim 10, wherein said control means is further capable of arbitrarily adjusting the magnitude of said electrical current within said third coil, so that the strength of said magnetic field within said central cavity can be adjusted.

12. An electromagnet as recited in claim 10, further comprising:

a. a fourth coil, including i. a fourth center axis running from a first end of said fourth coil to a second end of said fourth coil, wherein said fourth center axis is aligned with said first center axis;

ii. a fourth helical conductor, wrapped around said third coil, wherein said fourth helical conductor is formed by a plurality of 360 degree turns;

iii. wherein each of said plurality of turns lies approximately in one of a fourth plurality of offset parallel planes;

iv. wherein a normal vector for each of said plurality of offset parallel planes is angularly displaced from said first center axis; and b. wherein said control means is further capable of causing an electrical current to flow in an arbitrary fourth direction within said fourth coil, so that said angularly displaced magnetic field within said central cavity can be oriented in an arbitrary direction.

13. An electromagnet as recited in claim 12, wherein said control means is further capable of arbitrarily adjusting the magnitude of said electrical current within said fourth coil, so that the strength of said magnetic field within said central cavity can be adjusted.

* * * * *